US012117166B2

(12) United States Patent
Willis

(10) Patent No.: US 12,117,166 B2
(45) Date of Patent: Oct. 15, 2024

(54) METHOD FOR FABRICATION OF CORROSION-RESISTANT TUBING USING MINIMAL QUANTITIES OF SPECIALIZED MATERIAL

(71) Applicant: Caliber Elements LLC, Homosassa, FL (US)

(72) Inventor: Eric Willis, Homosassa, FL (US)

( * ) Notice: Subject to any disclaimer, the term of this patent is extended or adjusted under 35 U.S.C. 154(b) by 100 days.

(21) Appl. No.: 18/045,183

(22) Filed: Oct. 10, 2022

(65) Prior Publication Data

US 2024/0117964 A1 Apr. 11, 2024

(51) Int. Cl.
*F22B 37/10* (2006.01)
*F22B 37/04* (2006.01)
*F22B 37/20* (2006.01)

(52) U.S. Cl.
CPC ..... *F22B 37/108* (2013.01); *F22B 37/04* (2013.01); *F22B 37/205* (2013.01)

(58) Field of Classification Search
CPC ..... F22B 37/108; F22B 37/04; F22B 37/205; B23K 9/0253; B23K 9/0288
See application file for complete search history.

(56) References Cited

U.S. PATENT DOCUMENTS

2007/0181643 A1* 8/2007 Craig ..... B23K 9/0026 228/101
2008/0163792 A1* 7/2008 Seitz ..... F23M 5/08 427/456
2008/0318078 A1* 12/2008 Matsubara ..... B23K 9/235 428/615
2015/0167960 A1* 6/2015 Borek ..... B23K 26/342 29/890.051
2021/0325035 A1* 10/2021 Agema ..... F22B 37/108

FOREIGN PATENT DOCUMENTS

CN 110030545 A * 7/2019 ..... F22B 37/101

OTHER PUBLICATIONS

CTS Tubes. "ASTM A210 ASME SA210 GR. A1 Seamless Tubes", dated Aug. 6, 2020. (https://web.archive.org/web/20200806104635/https://www.ctstubes.com/product/astm-a210-asme-sa210-grade-a1-seamless-tubes/). (Year: 2020).*
English translation of CN-110030545-A, dated Mar. 7, 2024 (Year: 2024).*

* cited by examiner

*Primary Examiner* — Edelmira Bosques
*Assistant Examiner* — Brett Peterson Mallon
(74) *Attorney, Agent, or Firm* — Larson & Larson; Justin P. Miller; Frank Liebenow

(57) ABSTRACT

The method for fabrication of corrosion-resistant tubing using minimal quantities of specialized material results in corrosion-resistant tubes with a reduced capital cost. In contrast, the disclosed method uses a straight weld made along the length of the tube, rather than a spiral weld that follows its circumference. The straight weld passes up and down the tube, but only on one side, or approximately 50%, of the tube. Following application of the corrosion-resistant material by straight welding, two or more tubes are joined together into an array.

4 Claims, 7 Drawing Sheets

METHOD FOR FABRICATION OF CORROSION-RESISTANT TUBING USING MINIMAL QUANTITIES OF SPECIALIZED MATERIAL

FIELD

This invention relates to the field of heat exchanger tubing fabrication and more particularly to a method for fabricating heat exchanger tubes while reducing required quantities of high-cost materials.

BACKGROUND

Industrial steam boilers are used in a variety of settings including factories, power plants, and refineries. The generated steam is used to power a variety of equipment.

Inside an industrial steam boiler, water passes through tubing adjacent to a heat source. This is a difficult and high-stress environment for materials with exposure to a combination of heat, exhaust gases, and water. The result is rapid material degradation.

Specialized materials can be used to increase boiler life, thereby reducing maintenance and downtime.

But specialized materials are costly, particularly nickel, increasing the capital cost of a boiler. What is required is a method of fabricating corrosion-resistant boiler tubing while minimizing the required quantity of expensive materials.

SUMMARY

The method for fabrication of corrosion-resistant tubing using minimal quantities of specialized material results in corrosion-resistant tubes with a reduced capital cost.

Prior art methods of creating corrosion-resistant boiler tubes required welding a corrosion-resistant material around the full perimeter of each individual tube, and then joining the tubes together to create a boiler tube array. The weld was generally circumferential, spiraling around the circumference of the tube.

In contrast, the disclosed method uses a straight weld, or linear weld, made along the length of the tube. The straight weld passes up and down the tube, but only on one side, or approximately 50%, of the tube.

Stated differently, the corrosion-resistant material is applied along only one-half of the circumference of the tube, leaving the other circumference without corrosion resistant material applied by welding. The result is a first surface and a second surface, of approximately equal surface area, the first surface beneath a corrosion-resistant material applied by welding, and the second surface without a corrosion-resistant material applied by welding.

The corrosion-resistant material is applied to the tubes before the tubes are affixed to each other. This is important because applying to individual tubes allows the welding tools to be held perpendicular to the surface of the tubing during application of the corrosion-resistant material. The result is improved application and more consistent welds.

Following application of the corrosion-resistant material by straight welding, two or more tubes are joined together into an array, generally oriented parallel to each other.

The tubes are oriented with respect to each other such that the corrosion-resistant halves all face in same direction, and the untreated, or non-corrosion-resistant halves, all face the opposite direction.

During installation, the corrosion-resistant half of the resulting tubing array is placed toward the heat source, resulting in the corrosion-resistant material being used only where it is most needed.

As a result, the system requires approximately half as much corrosion-resistant material, thereby reducing material consumption and associated material cost and labor cost.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
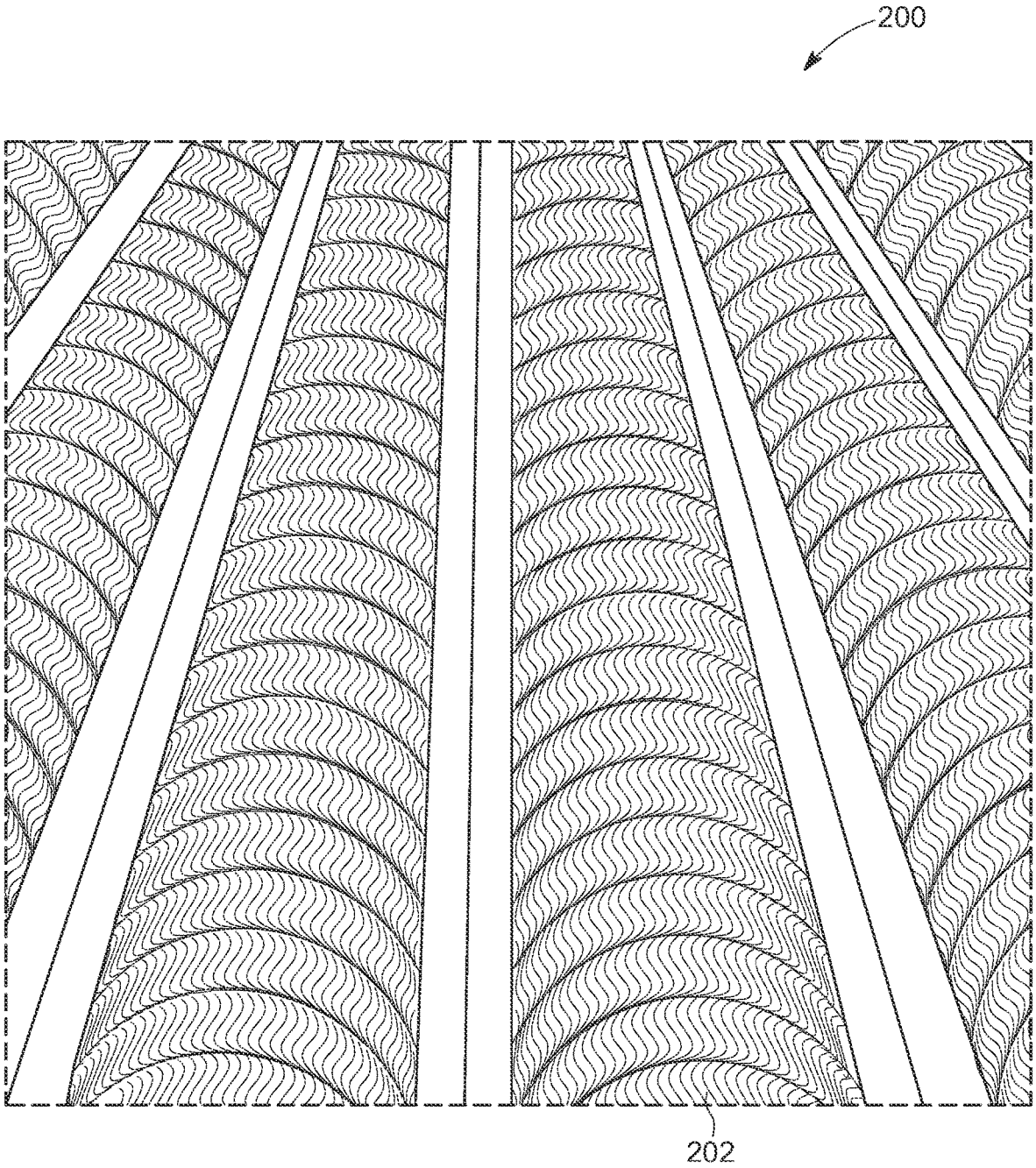
FIG. 1 illustrates a first isometric view of the prior art.

Reference will now be made in detail to the presently preferred embodiments of the invention, examples of which are illustrated in the accompanying drawings. Throughout the following detailed description, the same reference numerals refer to the same elements in all figures.

Figure 2:
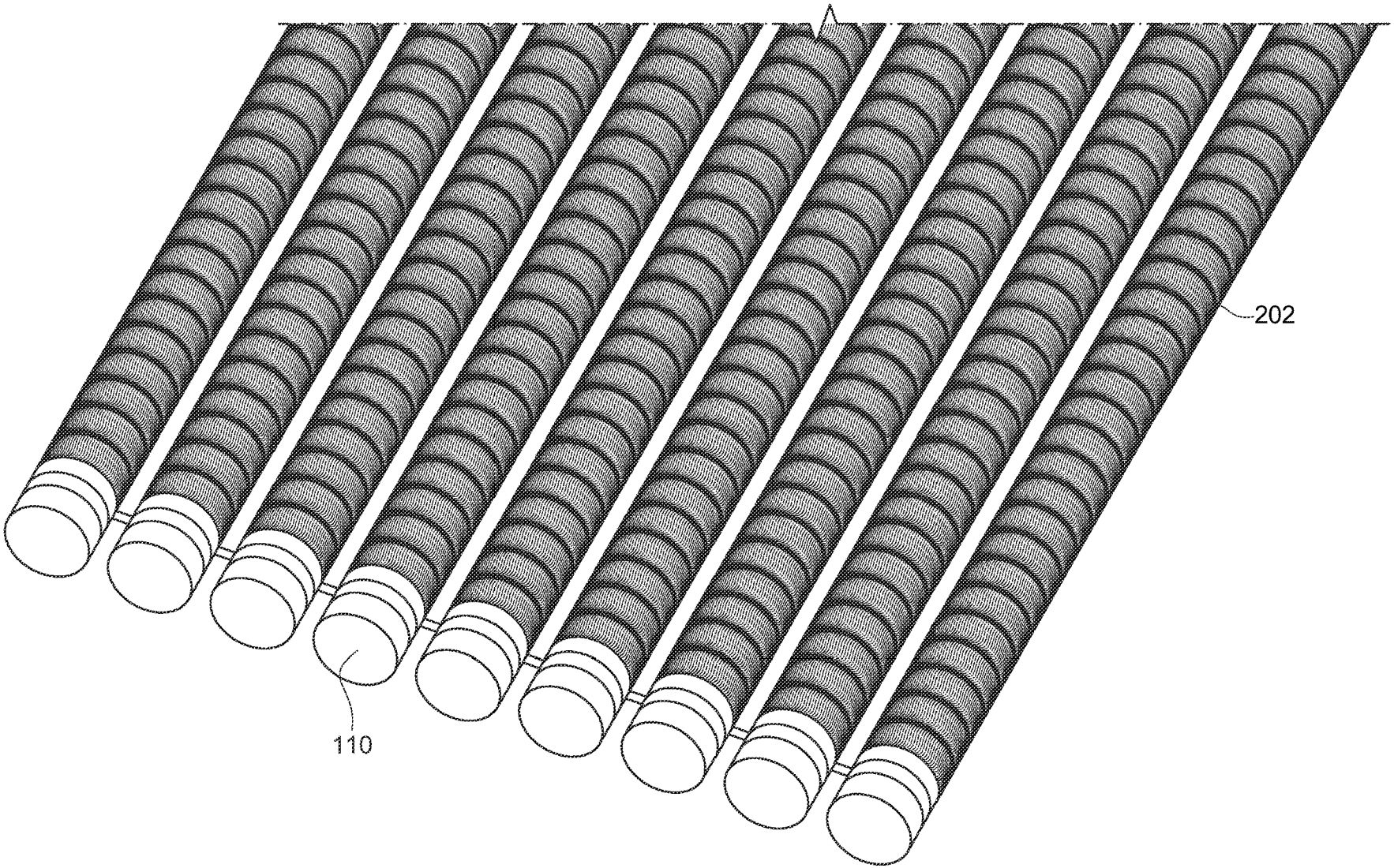
FIG. 2 illustrates a second isometric view of the prior art.

Referring to FIGS. 1 and 2, first and second isometric views of the prior art are shown.

The prior art boiler tube array with double-sided corrosion protection 200 includes a spiral protective weld 202 wrapping around 100% of the circumference of each tube 110. The result is that corrosion-resistant material is used on sections of the tube array where corrosion resistance is critical, as well as on sections where corrosion resistance is not required.

Figure 3:
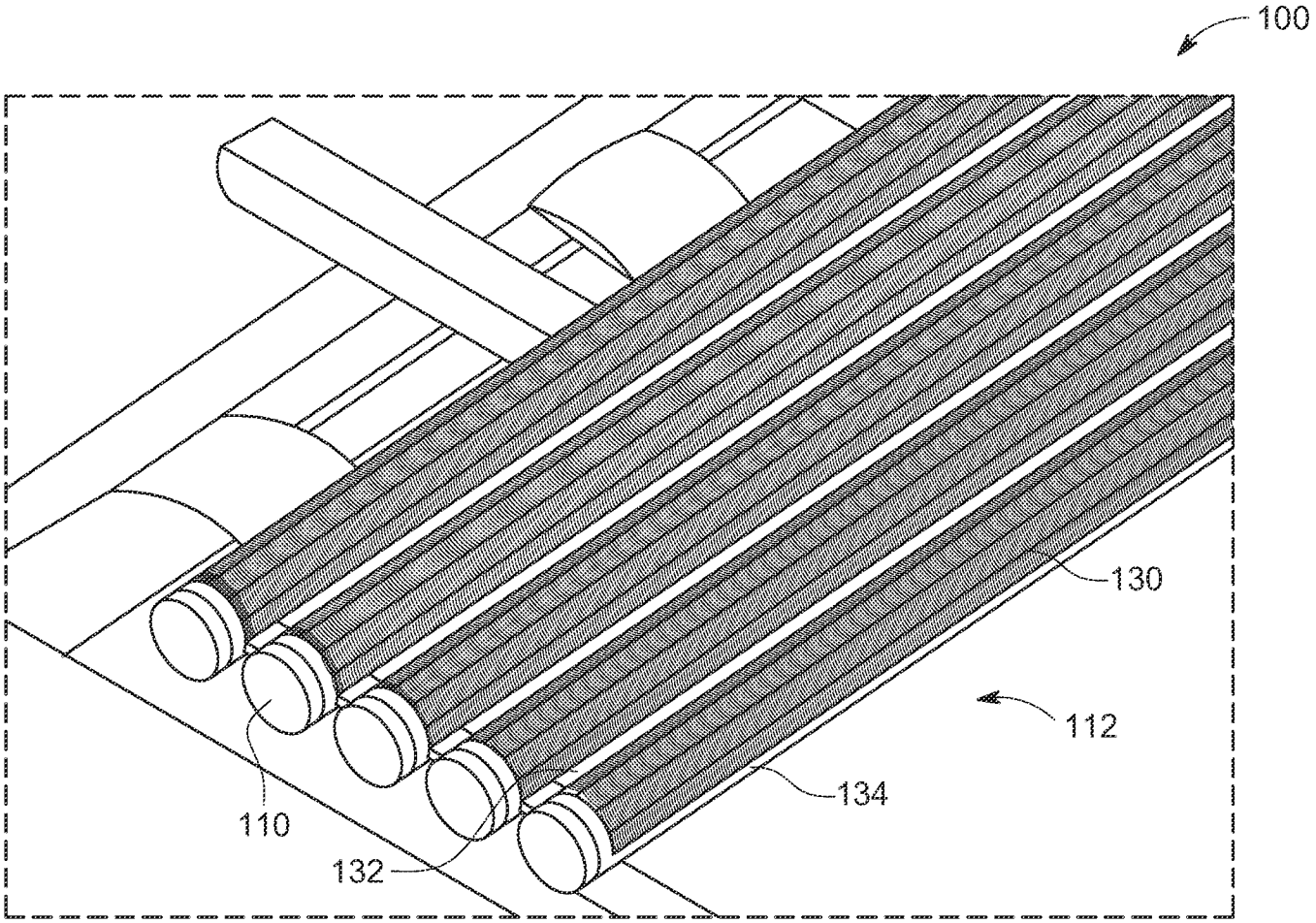
FIG. 3 illustrates a first isometric view of the corrosion-resistant tubing fabricated with minimal quantities of specialized material.
Figure 4:
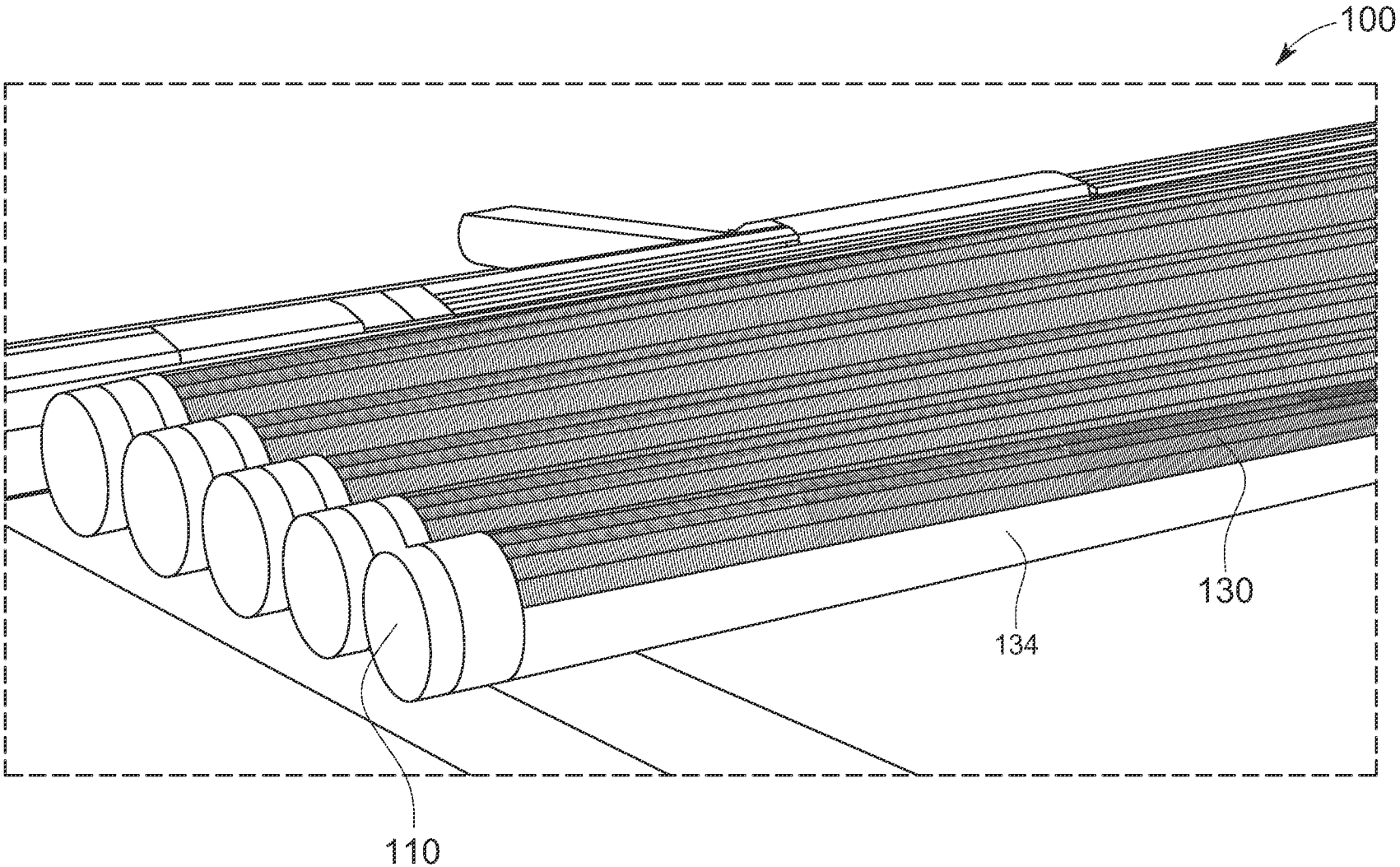
FIG. 4 illustrates a second isometric view of the corrosion-resistant tubing fabricated with minimal quantities of specialized material.

Referring to FIGS. 3 and 4, first and second isometric views of the corrosion-resistant tubing fabricated with minimal quantities of specialized material are shown.

The boiler tube array with single-sided corrosion protection 100 is shown fabricated from multiple tubes 110, joined together to create a tube array 112.

Each tube no is separated into two halves: a first-half covered by the linear protective weld 130, in the second-half that is the tube without protective weld 134. The second-half without the protective weld 134 is either left uncoated, or is coated by a material applied in a process other than welding, such as paint.

Figure 5A:
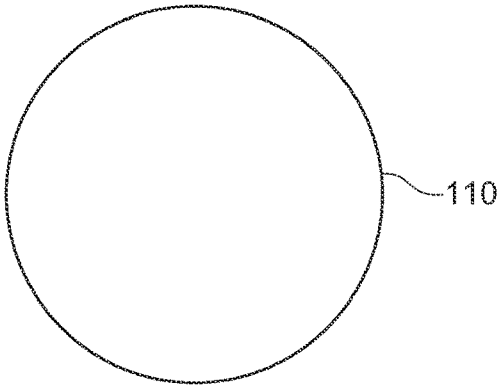
FIG. 5A illustrates a first step in preparation of the corrosion-resistant tubing fabricated with minimal quantities of specialized material.
Figure 5B:
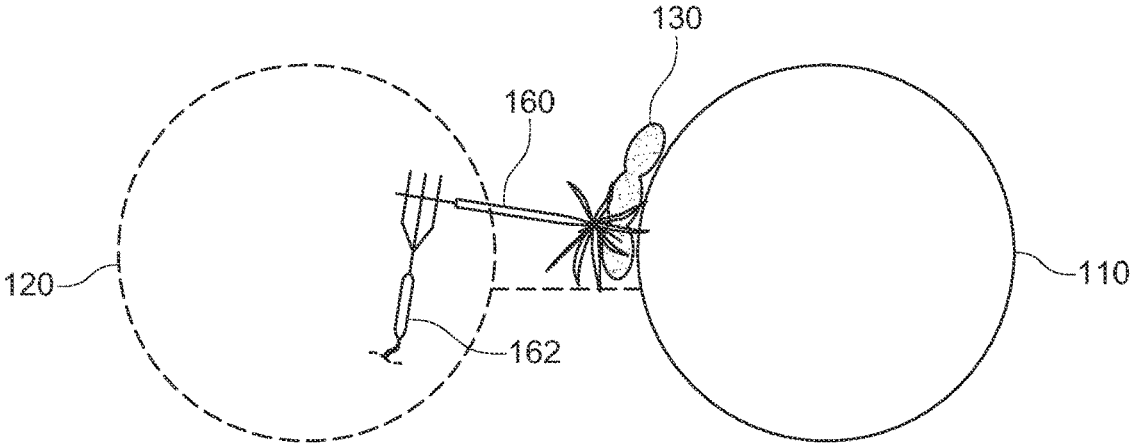
FIG. 5B illustrates a second step in preparation of the corrosion-resistant tubing fabricated with minimal quantities of specialized material.
Figure 5C:
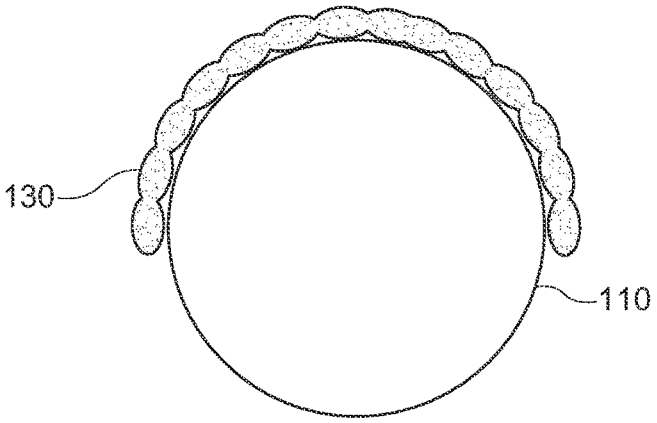
FIG. 5C illustrates a third step in preparation of the corrosion-resistant tubing fabricated with minimal quantities of specialized material.

Referring to FIGS. 5A, 5B, and 5C, a first, second, and third step in preparing the corrosion-resistant tubing fabricated with minimal quantities of specialized material is shown.

Figure 7:
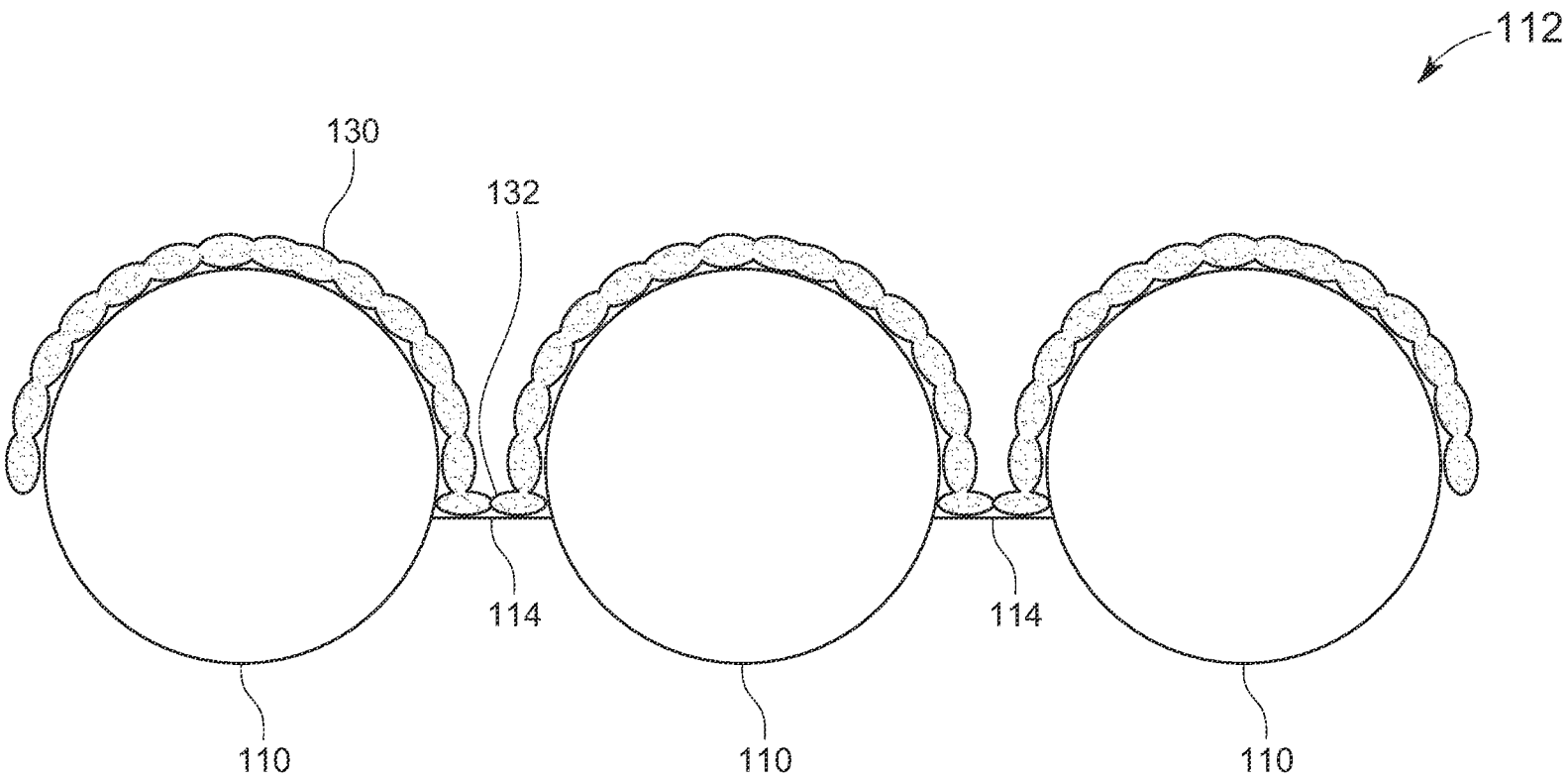
FIG. 7 illustrates a fifth step in preparation of the corrosion-resistant tubing fabricated with minimal quantities of specialized material.

Multiple tubes no are required to form a tube array 112 (see FIG. 7).

Tube material is preferably SA210-A1, a seamless medium carbon steel fabricated to ASTM A210/ASME SA210 specifications.

FIG. 5A shows a tube no before application of protective weld.

FIG. 5B shows the application of the linear protective weld 132 a tube 110. The linear protective weld 110 is applied by an electrode 160 supported by an electrode holder 162.

The disclosed method is different from the prior art in part because the linear weld is applied to each tube 110 individually, before assembly of the tubes into an tube array 112. This allows for application of the weld with the electrode 160 perpendicular, or nearly perpendicular, to the surface of the tube no.

As an example, an adjacent tube 120 is shown in dashed lines where would be placed if the tubes 110 were assembled into an array 112 before application of the linear protective weld 130.

One can see that the electrode 160 and electrode holder 162 cannot be held in a position perpendicular to the surface of the tube 110 if an adjacent tube 120 is present because the adjacent tube 120 blocks this location.

The result, is that in the prior art, the welds along the edges of the tube 110, and where the two tubes 110 meet, are performed at sharp angles, which reduces the quality of the weld and the resulting corrosion protection.

Only by applying a linear protective weld 130 in advance of assembling the individual tubes no can a high-quality weld be created, as shown in FIG. 5C.

Figure 6:
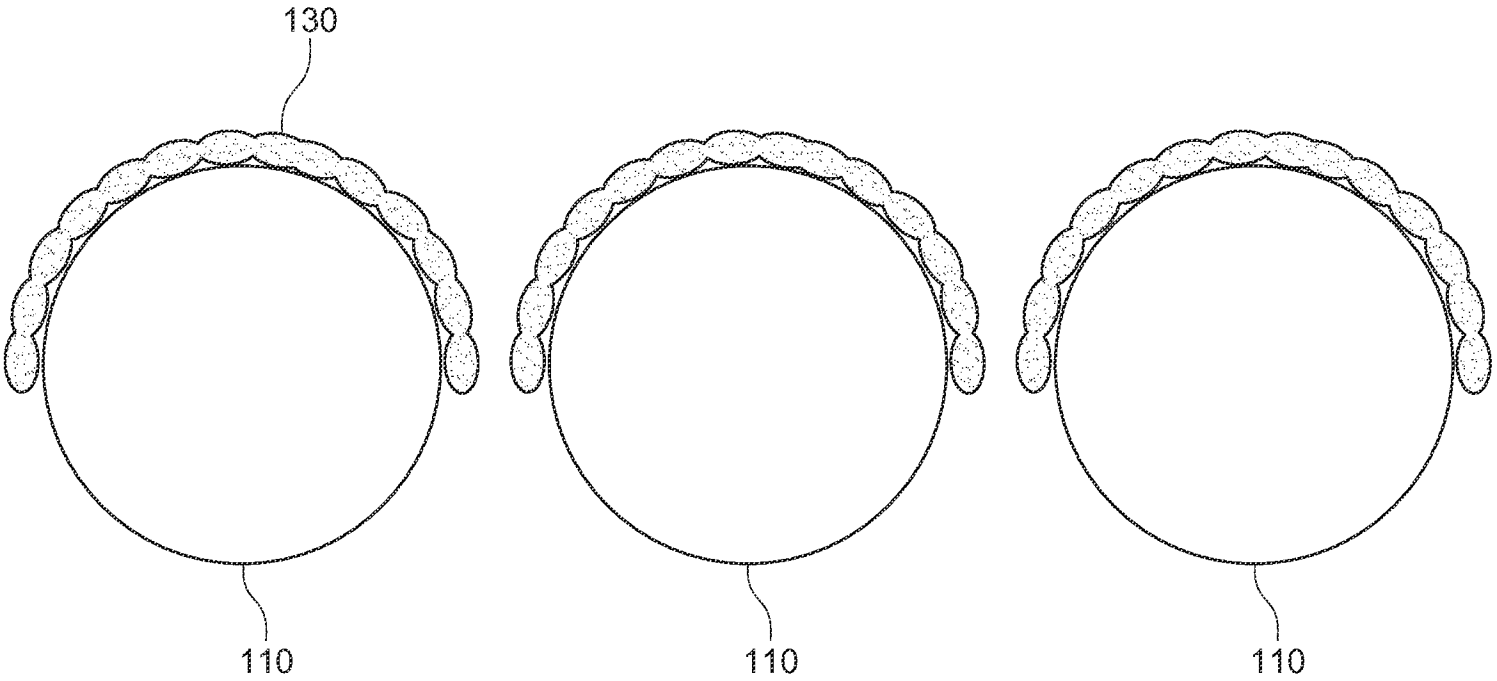
FIG. 6 illustrates a fourth step in preparation of the corrosion-resistant tubing fabricated with minimal quantities of specialized material.

Referring to FIG. 6, a fourth step in preparing the corrosion-resistant tubing fabricated with minimal quantities of specialized material is shown.

The linear protective weld 130 is applied over the tube 110.

The linear protective weld is preferably formed from Inconel 625, a nickel-based alloy. Inconel 625 is strong, corrosion resistant, and oxidation resistant. But its high nickel content makes it an expensive material. Thus, reducing the quantity required is critical to reducing the cost of the resulting boiler tube array 112.

Referring to FIG. 7, a fifth step in preparing the corrosion-resistant tubing fabricated with minimal quantities of specialized material is shown.

After each tube 110 includes a linear protective weld 130 along approximately 50% of its circumference, a backing plate 114 is added, welded into place with linear linking welds 132.

The backing plate 114 is preferably formed from ¼" thick Incoloy Boo, a nickel-iron-chromium alloy.

The linking welds 132 are preferably formed from Inconel 625.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method of creating a corrosion-resistant boiler tube array comprising the following steps, performed in the sequence set forth:

first welding a corrosion-resistant material on approximately half of a circumference of a first carbon steel tube;

next welding the corrosion-resistant material on approximately half of the circumference of a second carbon steel tube;

next orienting the first carbon steel tube with respect to the second carbon steel tube such that the corrosion-resistant material of the first carbon steel tube and the corrosion-resistant material of the second carbon steel tube faces a first direction;

and then welding a backing plate between the first carbon steel tube and the second carbon steel tube;

whereby limiting application of the corrosion-resistant material to only one-half of the first carbon steel tube and the second carbon steel tube reduces a quantity of corrosion-resistant material required, thereby reducing cost.

2. The method of creating a corrosion-resistant boiler tube array of claim 1, wherein the corrosion-resistant material is linearly welded, or welded along a length of the first carbon steel tube.

3. The method of creating a corrosion-resistant boiler tube array of claim 1, wherein the corrosion-resistant material is nickel-chromium alloy 625.

4. The method of creating a corrosion-resistant boiler tube array of claim 1, wherein the first carbon steel tube is made from SA210-A1.

* * * * *